United States Patent [19]

Tischenko et al.

[11] 4,089,210

[45] May 16, 1978

[54] DEVICE FOR MEASURING FILTERING PROPERTIES OF PAPER PULP

[76] Inventors: Alexandr Fedorovich Tischenko, bulvar Shevchenko, 9/28, kv. 27; Nisson Meerovich Yanishevsky, ulitsa Iskrovskaya, 3, kv. 46; Mikhail Alexandrovich Ivanov, ulitsa Scherbakova, 90, kv. 24, all of Kiev, U.S.S.R.

[21] Appl. No.: 753,001

[22] Filed: Dec. 21, 1976

[30] Foreign Application Priority Data

Jan. 15, 1976 U.S.S.R. ..... 2312302

[51] Int. Cl.[2] ..... G01N 15/00

[52] U.S. Cl. ..... 73/63

[58] Field of Search ..... 73/63, 61 R; 162/198, 162/263

[56] References Cited

U.S. PATENT DOCUMENTS

| | | | |
|---|---|---|---|
| 2,346,746 | 4/1944 | Green | 73/63 |
| 3,186,215 | 6/1965 | Danforth | 73/63 |
| 3,330,151 | 7/1967 | Reinhall | 73/63 |
| 3,538,749 | 11/1970 | Danforth | 73/63 |
| 3,688,563 | 9/1972 | Enarsson et al. | 73/63 |

FOREIGN PATENT DOCUMENTS

| | | | |
|---|---|---|---|
| 1,406,681 | 9/1975 | United Kingdom | 73/63 |

*Primary Examiner*—Richard C. Queisser
*Assistant Examiner*—Joseph W. Roskos
*Attorney, Agent, or Firm*—Steinberg & Blake

[57] ABSTRACT

Filtering property of paper pulp is measured by the height of a filtrate column by periodically immersing a vessel having a filter bottom into the pulp. The device for measuring filtering properties of paper pulp with the aid of the vessel having the filter bottom, has a pneumatic system that immerses the vessel with the filter bottom into or removes it from the pulp at a certain time interval, and also a follow-up system for recording the result of each measurement of the filtrate level in the vessel by the magnitude of the hydrostatic pressure as measured by a bubbler. The device for measuring the filtering property of paper pulp is characterized in that the vessel with the filter bottom consists of two communicating compartments having unequal cross section areas, the bubbler being installed in the smaller compartment. The device ensures high accuracy of measurement of the filtering property of paper pulp in the course of time, that makes it possible to utilize the proposed device in a system for automatic control of the pulp grinding process.

5 Claims, 1 Drawing Figure

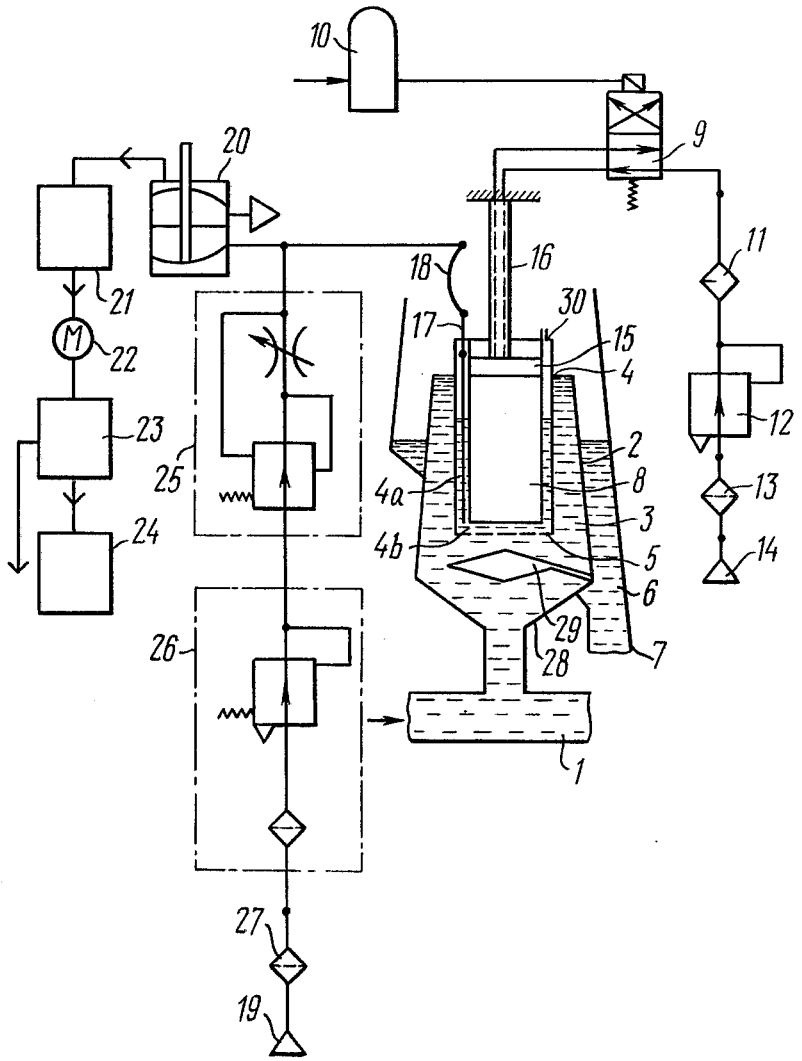
10
9
20
11
18
16
30
17
15
4
21
M
22
12
23
2
25
8
13
4a
3
24
4b
5
14
6
29
26
28
7
1
27
19

DEVICE FOR MEASURING FILTERING PROPERTIES OF PAPER PULP

The present invention relates to control instruments used in the pulp and paper industry, and more particularly it relates to devices for measuring filtering properties of paper pulp that is transported to paper-making machines through pulp ducts.

The invention will be more advantageously utilized in automatic systems that control the process of paper pulp grinding.

The filtering property of a paper pulp — i.e. the ability to give off part of its moisture through a filter — is the factor that characterizes the extent to which a particular pulp is ground.

The accuracy of measuring the degree of grinding or heating of the pulp, which is important to control quality of the finished product, depends on such factors as the pressure in the paper pulp duct, the temperature and concentration of the pulp.

Various devices have been proposed for reliable control of the paper-making process. Known in the prior art is a device for measuring the filtering properties of paper pulp, comprising a vessel sealed hermetically on one end and having on its other end an opening that connects the vessel with the pulp duct, and a filter closing the opening.

The vessel accommodates a means for measuring the level of filtrate that passes into the vessel through the filter. To eliminate reading erros of said known device, that arise from the change of pressure inside the pulp duct, the device is provided with a means for measuring the pressure of the paper pulp. The upper part of the vessel is provided with a pipe connection through which compressed air is supplied into the vessel.

Acted upon by the pressure inside the pulp duct, the liquid constituent of the paper pulp is passed through the filter, whereas the solid fibers are retained by the filter to form a bed on its surface. The level of the filtrate collected in the vessel is indicative of the filtering properties of a particular paper pulp. Once the measurement has been completed, the liquid and the retained solids are removed from the vessel by compressed air, after which the apparatus is ready for another measurement.

The known device responds only to significant fluctuations of pressure inside the pulp duct, while smaller fluctuations do not activate the instrument due to its low sensitivity and high inertia. This produces an error in measuring filtering properties of paper pulp.

The tightness of the vessel is another factor that affects the measurement results, since it becomes impossible to rule out the effect of the pulp temperature that fluctuates within a wide range and induces fluctuations of the pressure inside the pulp duct.

An attempt to incorporate a means for measuring pressure in the pulp duct into the device for measuring the level of the filtrate complicates the design of the known device and impairs the reliability of its readings, since a correction for pressure should be introduced into the obtained filtrate level data.

Furthermore, blowing out the filtrate from the vessel by compressed air results in its penetration into the pulp duct, which decreases the fluidity of the pulp and deteriorates its paper-forming properties.

Said disadvantages have been removed in a device for measuring the filtrating properties of paper pulp, covered by British Pat. No. 1,406,681.

This device comprises a fixed-level pulp reservoir which can be installed on a pulp duct, a vessel with a gauze in the bottom, a device that can either hold the reservoir above the level of the pulp or immerse into it, and a means for measuring the filtrate level in the vessel.

Said vessel is a hollow cylinder with an opening in the bottom, covered with a filter, whose area is equal to that of the cylinder section. The cylinder is provided with a means for measuring the level of the filtrate that penetrates into the cylinder as it is immersed to the required depth into the paper pulp in the fixed-level reservoir.

The known device accurately measures the filtering properties of paper pulp and is quite effective with manual control of the grinding process, but it cannot to be used in automatic control system due to its low speed of measurements. This is explained by the fact that the section area of the filter is equal to that of the cylinder section, as a result of which the filtrate level rises slower than the filtrate volume increases, and the time of each measurement is therefore significant.

The object of this invention is to provide a device for measuring the filtering properties of paper pulp, ensuring high-accuracy information on the degree of pulp grinding, with a short duration of the measurements ensuring the capability of utilization of said device in automatic process control systems.

Another object of the invention is to provide a compact device for measuring filtering properties of paper pulp, that could be installed at any point of the pulp duct.

Said and other objects have been attained in a device for measuring filtering properties of paper pulp, comprising a fixed-level pulp reservoir that is installed on a pulp duct, a vessel with a filter bottom, a device that can either hold the vessel above the pulp level or immerse it into the paper pulp, incorporating a power cylinder and a means for measuring the filtrate level in the vessel, connected with a follow-up system, in which, according to the invention, the vessel consists of two communicating compartments having different cross section areas, the means for measuring the filtrate level being installed in the smaller one.

With this design of the vessel, the level of the filtrate rises faster than its volume increases, which shortens the time of measuring the filtrate level as many times as the area of the cross section of the larger compartment is greater than that of the smaller one. Furthermore, the invention increases the accuracy of measurement of filtering properties of paper pulp, since the level of the same volume of the filtrate will be higher in the proposed device than in the known ones.

It is recommended that the area of the smaller cross section should be limited by the inner surface of the vessel and a power cylinder, which is located in the vessel, so that the compartment of the vessel having the larger cross section is limited by the filter bottom of the vessel and the end of the power cylinder.

Such installation of the power cylinder inside the vessel considerably diminishes the height of the device.

For a better understanding of the invention it will be further illustrated by a detailed description of an example of its practical embodiment and the appended drawing that shows a schematic diagram of the proposed device for measuring filtering properties of paper pulp according to the invention.

The proposed device for measuring filtering properties of paper pulp comprises a fixed-level reservoir 2 for paper pulp 3, which is installed on a pulp duct 1, a vessel 4 with a gauze bottom 5, a device that can change the position of the vessel 4 and the reservoir 2 with respect to each other, and a means for measuring the filtrate level, connected with a follow-up system.

As can be seen from the drawing, the fixed-level reservoir 2, open at its upper end, is installed on the pulp duct 1 through which paper pulp is transported to the paper-making machine (not shown in the drawing). The reservoir 2 is placed inside another reservoir 6 connected to the pulp duct 1 by a pipe 7. Paper pulp overflowing reservoir 2 is reserved in the reservoir 6 and is returned to the pulp duct at a location downstream of reservoir 2 in the direction of pulp current flow toward the paper-making machine. Paper pulp 3 is delivered into the fixed-level reservoir 2 and overflows into the reservoir 6 to maintain a constant level of the pulp in the reservoir 2. The portion of the paper pulp contained in the fixed-level reservoir 2 is the sample the filtering properties of which are to be determined. Since the pulp is in constant motion, its portions are continually renewed, and the measurements are therefore done with new and incessantly renewing portions of the pulp.

The device according to the invention is provided with a means that can change the position of the fixed-level reservoir 2 and the vessel 4 with respect to each other, and that serves to immerse the vessel 4 into and remove it from the pulp 3.

Said means comprises a double-acting power cylinder 8 actuated by compressed air, an air distributor 9 for delivery of compressed air into the power cylinder by the command issued by a timer 10, an oil atomizer 11 serving to introduce oil into the air distributor 9, a reducing valve 12 intended to control air pressure, a filter 13 intended to clean the air delivered into the reducing valve, and a source of air supply 14.

The timer 10 controls the work of the air distributor 9 so that the vessel 4 is immersed into the paper pulp to a predetermined depth and raised above the pulp level in a certain period of time.

The power cylinder 8 has a piston 15 connected with a rod 16. The latter has two longitudinal channels that connect the working cavities of the power cylinder with the air distributor 9. The rod is secured to the body of the fixed-level reservoir 2.

The fixed connection of the rod 16 to the body of the reservoir 2 is preferred, but other versions of embodiment of the invention can occur to those skilled in the art without departing from the spirit of the invention. The reason for which the described type of connection is preferred will become apparent from the description that follows hereinafter.

According to the invention, the vessel 4 with the filter bottom 5 consists of two communicating compartments **4*a* and 4*b*** having unequal cross section areas.

In order to lessen the height of the proposed device, the power cylinder 8 is placed inside and fixed to the vessel 4.

The compartment **4*a* of the vessel 4 having the smaller area of its cross section, is limited by the inner surface of this vessel and the outer surface of the power cylinder 8, while the compartment 4*b* having the larger area, is limited by the filter bottom 5** and the bottom, closed end of the power clyinder.

The means for measuring the level of the filtrate is installed inside the compartment **4*a* having the smaller section area. In the present example said means is a bubbler 17** but other means of measuring level, such as a float, electrical contacts, etc., may also be used for the purpose.

The bubbler 17 is connected by a flexible hose 18 with the follow-up system that records the results of each measurement and with the system delivering air into the bubbler 17 from the source of compressed air 19.

Said follow-up system for recording the results of each measurement comprises a means for measuring air pressure, e.g. a known differential pressure gauge 20, provided with a differential transformer (not shown in the drawing), a comparator unit 21 connected electrically with the differential pressure gauge 20, and a reversible electric motor 22 whose shaft is connected with a mechanoelectrical transducer 23 that transmits a signal to a recording instrument 24.

The source of compressed air 19 is connected with the bubbler 17 through an air flowmeter 25 that controls the air current into the bubbler 17, a reducing valve 26, and a filter 27.

The operating principle of the follow-up system is based on measuring the static pressure of the filtrate column in the vessel 4. The resistance of the filtrate to the passage of air builds up the back pressure which is proportional to the height of the filtrate column above the orifice of the bubbler 17.

For this reason the pressure P of the air at the exit from the bubbler 17 is connected with the filtrate level in the smaller compartment of the vessel 4 by the following functional relation $$P = H\gamma$$

where $H$ is the measured level of the filtrate above the orifice of the bubbler 17, and $\gamma$ is the density of the filtrate.

The air pressure in the bubbler 17 is measured by the differential pressure gauge 20. This pressure is applied to the first of the two chambers of the differential pressure gauge 20; to eliminate the effect of fluctuations in the atmospheric pressure, the second chamber of the pressure gauge communicates with the atmosphere.

The change of the pressure difference in the chambers of the differential pressure gauge 20 moves the core of the differential transformer (not shown in the drawing). This movement of the core changes the voltage and the phase at the output from the differential pressure gauge 20 and this is utilized by the comparator unit 21 in recording the filtrate level in the vessel 4 and controlling the reversible motor 22.

The latter function is realized by two microswitches (none of them shown in the drawing). The microswitches are preset for the requisite values of the filtrate levels. The first microswitch starts the reversible motor 22 when the level of the filtrate in the vessel 4 is minimum, and the second switch stops the motor 22 as the filtrate level attains its maximum. The level of the filtrate in the compartment having the larger cross section area (i.e. the level of the filtrate passed through the filter bottom 5 before a bed of solids is formed on the gauze) is not recorded. It should be noted that the minimum and the maximum filtrate levels establish the minimum and the maximum air pressure in the bubbler 17 respectively. The mechanoelectrical transducer 23 is connected with the shaft of the electric motor 22. The transducer 23 transforms the angle of rotation of the electric motor shaft into an output electric signal that characterizes the filtering property of a particular paper pulp, i.e. the degree of grinding of the pulp, the signal being proportional to the time passed between the moment when the first and the second microswitches of the comparator unit 21 are actuated. The output signal of the transducer 23 is transmitted to the recording instrument 24, but it can as well be used in a system that automatically controls the pulp grinding process.

To eliminate the reading error of the device according to the invention, that can arise due to a hydraulic impact in the pulp duct 1, the fixed-level reservoir 2 is installed on a channel 28 that serves to admit paper pulp 3 into the fixed-level reservoir 2 and is mounted on the pulp duct 1. The channel 28 is made in the form of a cone widening uniformly in the direction of the pulp flow. It should be noted that this configuration of the channel is only illustrative, and that channels having other designs can also be used to the same effect.

Moreover, a baffle 29 is installed in the lower part of the fixed-level reservoir 2.

To ensure additional cleaning of the gauze bottom 5 after each measurement, as will be shown in the further description of operation of the proposed device, the upper part of the vessel 4 can be provided with a connection 30 through which compressed air or water can be delivered from a suitable source.

The proposed device for measuring filtering properties of paper pulp operates as follows.

As preset by the timer 10, the power cylinder 8 immerses the vessel 4 at certain time intervals and to a certain depth into the paper pulp 3 that passes into the fixed-level reservoir 2 from the pulp duct 1. Constant pressure is exerted on the filter bottom, and the liquid constituent of the pulp 3 passes through the filter 5 into the compartment **4*b* of the vessel 4** having the larger cross section area. As the liquid passes through the filter, a bed of solid constituents of the pulp is formed on the filter. The level of the filtrate is measured only after the bed of the solids has been deposited, as a result of which the fluctuations of the pulp concentration do not affect the measurement results, i.e. the filtrate level in the compartment of the larger cross section area is not considered.

The intensity of penetration and the quantity of the filtrate passed through the filter or gauze 5 into the compartment having the smaller section area, varies with the degree to which the pulp is ground. The level of the filtrate in the compartment **4*a* having the smaller section area is determined with the aid of the bubbler 17. Air pressure built up in the bubbler 17 is proportional to the height of the filtrate column in the compartment 4*a* having the smaller section area. This pressure is measured by the differential pressure gauge 20 that produces an electric signal proportional to the difference of pressures in the chambers of the differential pressure gauge. The electric signal is transmitted to the comparator unit 21 where the level of the filtrate in the compartment 4*a*** having the smaller section area is recorded.

As the level of the filtrate in the compartment **4*a* having the smaller section area attains its minimum, i.e. at the moment when the compartment 4*b* having the larger section area begins to be filled with the filtrate, the first microswitch of the comparator unit 21 starts the reversible electric motor 22 which is connected mechanically with the transducer 23. When the filtrate in the compartment 4*a* having the smaller section area rises to its maximum level, the second microswitch of the comparator unit 21 stops the electric motor 22. In accordance with the angle through which the shaft of the electric motor turns, the transducer 25 yields an electric signal proportional to the degree of grinding of the pulp, which is recorded by the instrument 24**.

After the second microswitch of the comparator unit 21 has operated, the pneumatic cylinder 8 removes the vessel 4 from the pulp by the command issued by the timer 10, and sets it in the initial position. The filtrate flows out from the vessel 4 through the filter bottom 5 to wash off the deposited pulp solids.

At the end of the measurement (as commanded by the timer 10) all the elements of the device, except the mechanoelectrical transducer 23, are reset to the initial state. The transducer is provided with a device (not shown in the drawing) that stores the electric signal till the next measurement. As the vessel 4 is raised, the filter bottom 5 can be given an additional wash by water delivered under pressure through the connection 30. Compressed air can also be used for the purpose, but the blowing should be done at the moment when the vessel 4 is withdrawn from the paper pulp so that air should not saturate it.

Thus, the structure of the invention includes an outer vessel means which forms the fixed-level pulp reservoir 2, this outer vessel means having a means for placing the interior thereof in communication with the pulp duct 1 so that the outer vessel means will receive in its interior pulp from the pulp duct 1. The vessel means 4 forms an inner vessel means which can be situated either in a position immersed in the pulp in the outer vessel means 2 or in a position situated above the pulp in the outer vessel means 2. Thus a means, formed by the power cylinder 8, is operatively connected with one of the above vessel means, namely the inner vessel means 4 in the illustrated example, for changing the position of the inner and outer vessel means 1 with respect to the other so as to situate the inner vessel means in either of the above positions with respect to the outer vessel means. The inner vessel means 4 has an imperforate side wall and the filter bottom 5, so that when the inner vessel means is in its immersed position with respect to the outer vessel means the pulp in the outer vessel means can enter the inner vessel means only through the filter bottom 5 thereof. The inner vessel means 4 has in its interior the compartment **4*b* of relatively large cross-sectional area into which the filtrate flows directly from the filter bottom 5, this inner vessel means 4 having also the interior compartment 4*a* of a cross sectional area much smaller than that of the compartment 4*b*. This compartment 4*a* of smaller cross sectional area communicates at its lower end directly with the compartment 4*b* of larger cross sectional area, so that the filtrate will flow from the compartment 4*b* into the compartment 4*a* and will rise in the latter at a relatively rapid rate due to its smaller cross-sectional area. Situated in the compartment 4*a* is the means for measuring the filtrate level in the inner vessel means 4, this latter measuring means being operatively connected with a follow-up system, as described above, for recording the results of the measurement made by the measuring means which is in the smaller compartment 4*a***.

The proposed device ensures successive measurements of the filtering properties of paper pulp within the course of time during which the process of pulp grinding can be corrected and adjusted by the automatic control system employing computers.

While a specific embodiment of the invention has been disclosed in the example, it will be understood that drive systems other than the pneumatic cylinder actuating the vessel 4 can be resorted to without limitation of the invention.

It should be understood also that various modifications concerning the configuration, dimensions, and mutual arrangement of the elements in the poposed device can readily occur to those skilled in the art without departing from the spirit and scope of the invention as defined in the appended claims.

We claim:

1. For use in the measurement of filtering properties of paper pulp, outer vessel means forming a fixed-level pulp reservoir and including a means for placing the interior of said outer vessel means in communication with a pulp duct so that pulp will flow from the pulp duct into the interior of said outer vessel means to form said fixed-level pulp reservoir, inner vessel means for receiving pulp from said outer vessel means and for discharging received pulp back to said outer vessel means, said inner vessel means having an immersed position situated at least partly within said outer vessel means and a non-immersed position situated above the level of the pulp in said outer vessel means, and said inner vessel means having an imperforate side wall and a filter bottom so that when said inner vessel means is displaced from said non-immersed to said immersed position thereof pulp in said outer vessel means will flow through said filter bottom of said inner vessel means into the interior thereof, said inner vessel means having in its interior a compartment of relatively large cross-sectional area situated directly above said filter bottom for receiving filtrate passing through said filter bottom directly from said filter bottom, and said inner vessel means having also in its interior a compartment of relatively small cross-sectional area communicating at a lower end directly with said compartment of relatively large cross-sectional area and extending upwardly from said compartment of relatively large cross-sectional area so that the filtrate will flow from said compartment of relatively large cross-sectional area at a relatively rapid rate upwardly along said compartment of relatively small cross-sectional area when said inner vessel means is displaced from said non-immersed to said immersed position thereof, power means operatively connected with one of said vessel means for changing the relative position between said inner and outer vessel means while displacing said inner vessel means between said positions thereof, measuring means situated in said compartment of relatively small cross-sectional area for measuring the filtrate level in said inner vessel means, and a follow-up system operatively connected with said measuring means for recording the results of a measurement made thereby.

2. The combination of claim 1 and wherein said power means is operatively connected with said inner vessel means for displacing the latter vertically between said positions thereof.

3. The combination of claim 2 and wherein said power means includes a cylinder extending into said inner vessel means and having a closed bottom end situated above said filter bottom of said inner vessel means for defining said compartment of relatively large cross-sectional area therewith, said cylinder having an outer surface situated inwardly from and surrounded by said imperforate wall of said inner vessel means for defining with said imperforate wall said compartment of relatively small cross-sectional area.

4. The combination of claim 3 and wherein said power means includes a stationary piston situated within and cooperating with said cylinder.

5. The combination of claim 1 and wherein a means communicates with said compartment of relatively small cross-sectional area and through the latter with said compartment of relatively large cross-sectional area for introducing into said inner vessel a fluid for cleaning said filter bottom thereof after each measurement when said inner vessel means is displaced from said immersed to said non-immersed position thereof.

* * * * *